United States Patent [19]

Elliott

[11] Patent Number: 4,524,542

[45] Date of Patent: Jun. 25, 1985

[54] ORNAMENTAL FIXTURE FOR SUSPENDING POTTED PLANTS

[76] Inventor: James J. Elliott, 700 Museum Dr., Charlotte, N.C. 28207

[21] Appl. No.: 555,665

[22] Filed: Nov. 28, 1983

[51] Int. Cl.[3] ..... A01G 9/02

[52] U.S. Cl. ..... 47/67; 47/68

[58] Field of Search ..... 47/67, 68; 248/215, 248/208, 303, 340

[56] References Cited

U.S. PATENT DOCUMENTS

| | | | |
|---|---|---|---|
| 17,956 | 7/1914 | Gibson | 47/67 |
| 1,558,977 | 10/1925 | Gray | 47/68 |
| 2,504,583 | 4/1950 | Rachic | 47/67 |
| 4,098,483 | 7/1978 | Pesola | 47/67 |
| 4,415,137 | 11/1983 | Garves | 47/67 |

*Primary Examiner*—Robert A. Hafer
*Assistant Examiner*—Bradley M. Lewis
*Attorney, Agent, or Firm*—Bell, Seltzer, Park & Gibson

[57] ABSTRACT

An ornamental bracket for suspendingly supporting potted plants or the like alongside the vertical extending surface of a wall, fence or the like. The bracket includes a loop portion for mounting to the wall, fence or the like and includes means for abutting the vertical surface so as to position the bracket to extend in an outwardly projecting manner from the vertical surface, and includes hook means positioned outwardly of and remote from the loop portion for receiving thereon a potted plant or the like so that the potted plant would be suspendingly supported alongside the vertical surface of the wall, fence or the like.

1 Claim, 8 Drawing Figures

ORNAMENTAL FIXTURE FOR SUSPENDING POTTED PLANTS

DESCRIPTION OF THE INVENTION

The present invention relates to an ornamental fixture for suspendingly supporting potted plants or the like alongside a wall, fence or the like.

The fixture is comprised of a skeletal bracket adaptable for use with a suitable mounting means. The bracket can loopingly and detachably engage the mounting means, and is further adapted to abut a wall, fence or the like so that the bracket, mounting means and abutting means cooperate to project the fixture outwardly from the vertical surface of the wall or fence to which it is mounted. The bracket also has hook means thereon for receiving the potted plant or the like. The invention provides a simple, detachable fixture suitable for suspendingly hanging objects alongside walls, fences, or the like.

Figure 2:
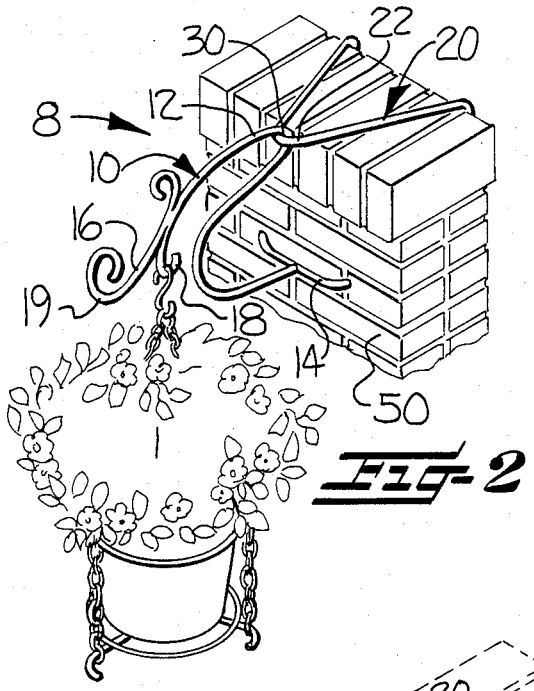
Figure 3:
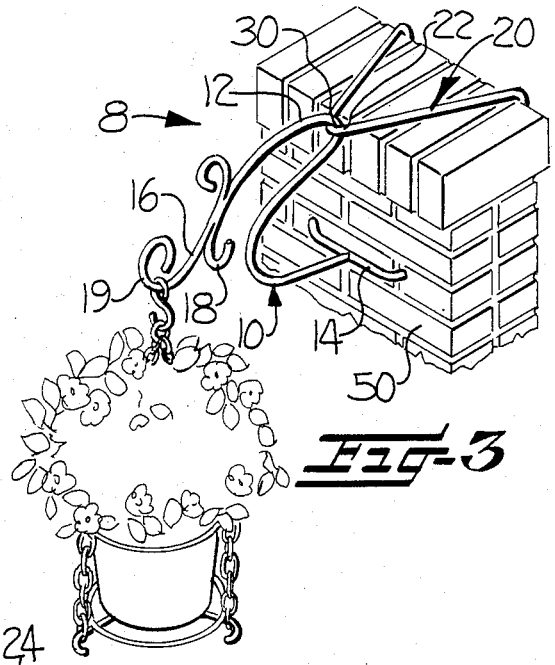
Figure 1:
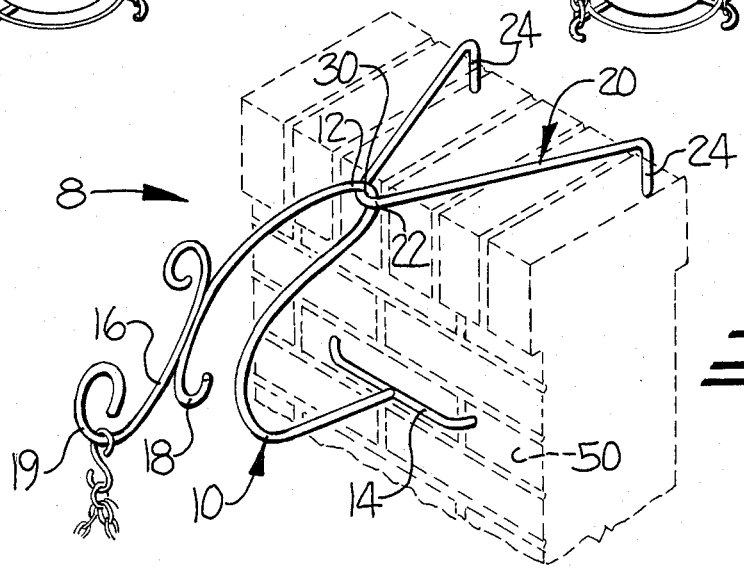
Figure 4:
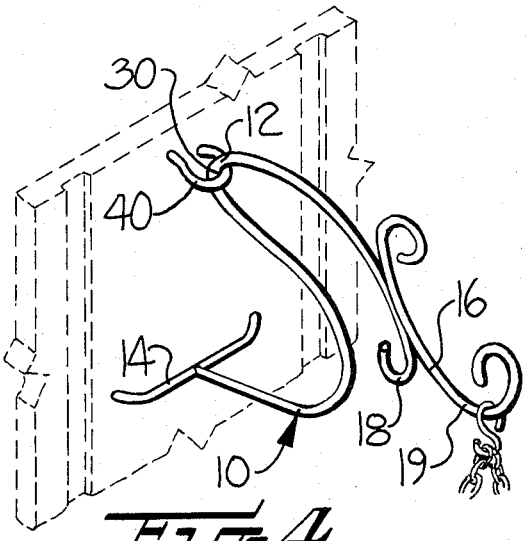
Figure 5:
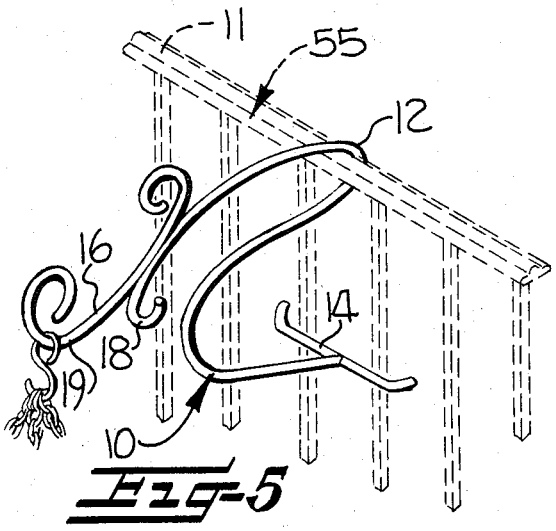
Figure 6:
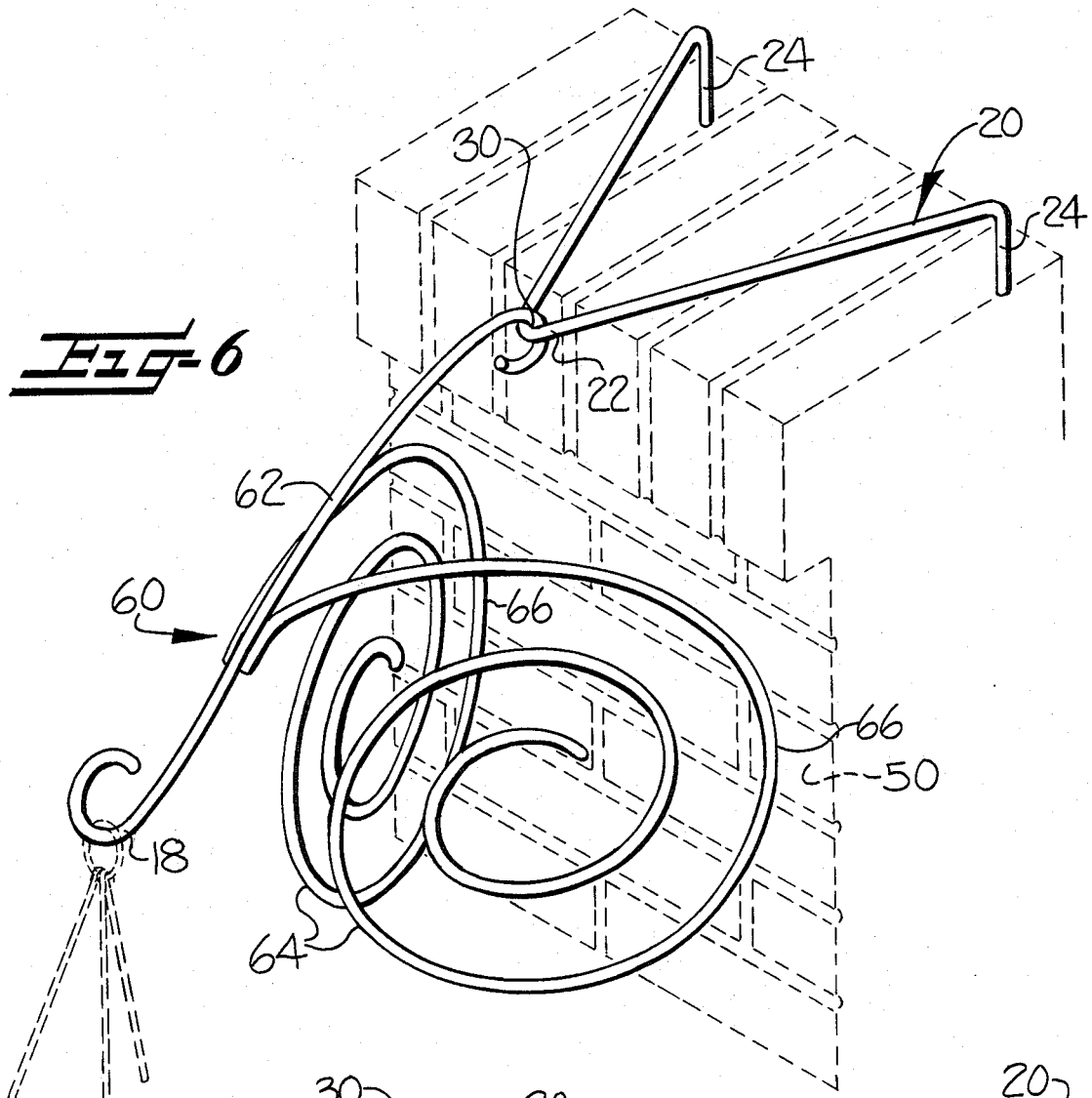
Figure 7:
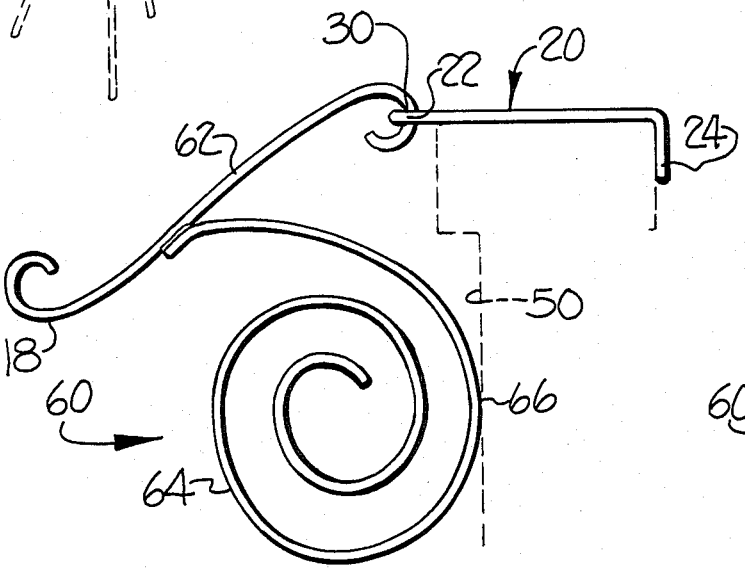
Figure 8:
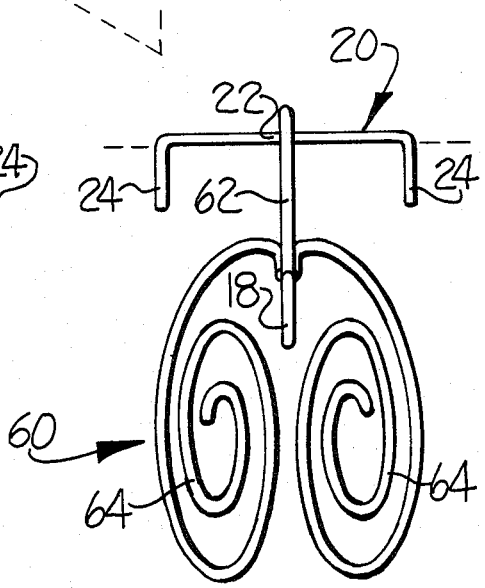

The present embodiment of the invention will be seen more clearly from the drawings, in which:

FIG. 1 is a perspective view of a first embodiment of the invention, including the bracket and mounting means, FIG. 2 is also a perspective view of the first embodiment of the bracket and mounting means showing a potted plant suspended from one of the hook means, FIG. 3 is a perspective view of the first embodiment of the invention showing a potted plant suspended from the hook means on an auxiliary body portion of the bracket, FIG. 4 is a perspective view showing the ornamental fixture of the invention mounted on alternative mounting means such as an eye-hook or eye-bolt, FIG. 5 is a perspective view showing the fixture loopingly engaged on a fence without the use of any other mounting means, FIG. 6 is a perspective view of a second embodiment of the ornamental fixture in accordance with the invention, FIG. 7 is a side elevation view of the fixture of FIG. 6, and FIG. 8 is a front elevation view thereof.

Turning to the invention in detail, as seen in FIG. 1 the ornamental fixture of the present invention is generally indicated by the reference character 8, and is comprised of a skeletal bracket 10 and a mounting means 20, each constructed of metal rod-like material. The bracket 10 includes a loop portion 12 which detachably interengages with a loop portion 22 of the mounting means 20 at point 30.

As FIG. 1 also shows, the skeletal bracket 10 has a sinuous configuration. Further, one end of the bracket 10 includes abutting means 14. These are shown in FIG. 1 as a pair of wall engaging feet positioned to abut the vertical surface of the wall 50 on opposite sides of the point of detachable engagement 30, thus stabilizing the entire fixture.

Similarly, as FIG. 1 shows, the mounting means 20 has a pair of wall-engaging feet 24 remote from the point of detachable engagement 30. These feet 24 engage the opposite side of the wall 50 from which the bracket 10 is supported and serve to brace the mounting means 20 more securely against the wall. The bracket 10 also can have an auxiliary body 16 extending somewhat upwardly and outwardly from the bracket 10, as FIG. 1 shows.

Both the main body of the bracket 10 and the auxiliary body 16 have hook means 18 and 19 respectively thereon for receiving and suspending the potted plant or the like. As FIGS. 2 and 3 show, a potted plant can be alternatively suspended from either hook means 18 on the main body of the bracket 10 or from hook means 19 on the auxiliary body 16. As a result, larger plants may be suspendingly supported from hook means 19 without any change in structure or position of the fixture.

As the drawings further show, the weight of the potted plant or the like which is suspended from the bracket 10 is exerted through the bracket 10 and against both the mounting means 20 and the abutting means 14. As exerted through the mounting means 20, the force is transferred to the wall-engaging feet 24. Likewise, the force exerted through the bracket 10 is pivotally transferred to the abutting means 14. The result of these weight transfers is that the weight of the suspended potted plant itself serves to firmly engage both the bracket 10 and the mounting means 20 against the wall, fence or the like. Consequently, the nature of the invention is such that as heavier potted plants or the like are suspended from the fixture, the bracket 10 and the mounting means 20 are more firmly held in place. An advantage of the present invention is that the increased weight of the suspended object results in an increasingly secure engagement of the fixture to the wall, fence or the like.

At the same time, another advantage of the present invention is that the bracket 10, either alone or in cooperation with the mounting means 20 is readily detachable from either the mounting means 20 or any other mounting means, including an eye-bolt 40 as shown in FIG. 4, or a fence 55 as shown in FIG. 5. As seen in FIG. 5, when mounted on a fence, the fence rail 11 serves as a mounting means for the bracket 10, with the loop portion 12 of the bracket engaging the fence rail 11. As the drawings show, all of the advantages of the invention are present even when these other types of suitable mounting means are used.

SECOND EMBODIMENT OF THE INVENTION

FIGS. 6, 7 and 8 show a second embodiment of the invention.

As FIG. 6 shows, the second embodiment of the invention has a bracket 60 and mounting means 20. As in the first embodiment, the main body 62 of the bracket 60 detachably engages the loop portion 22 of the mounting means 20 at a point 30.

Additionally, the bracket 60 has a pair of ancillary body members 64 connected to and depending from the main body 62. As FIGS. 6, 7 and 8 further show, these ancillary body members 64 are of substantially helical shape and as FIGS. 6 and 8 show, they diverge from the main body 62 towards the wall 50. Certain portions 66 of the ancillary body members 64 are arranged to abut the wall 50 and thus cooperate with the mounting means 20 to maintain the main body 62 in an outwardly projecting manner from the wall 50. As FIG. 6 shows, the portions 66 of the ancillary body member 64 which abut the wall 50, do so on opposite sides of the point of detachable engagement 30, thus stabilizing the entire fixture. As in the previous embodiment, hook means 18 are connected to and define one end of the main body 62 and serve to suspendingly receive a potted plant or the like.

As FIGS. 6 and 7 in particular show, the weight of a potted plant or the like which is suspended from the bracket 60 is exerted through the bracket 60 and against both the mounting means 20 and the abutting portions 66 of the ancillary body members 64. As in the previous embodiment, the force exerted through the mounting means 20 is transferred to the wall-engaging feet 24. Likewise, the force exerted through the bracket 60 is pivotally transferred to the abutting portions 66 of the ancillary body members 64. As in the previous embodiment, the nature of the weight transfer is such that as heavier potted plants or the like are suspended from the fixture, the bracket 60 and the mounting means 20 are more firmly held in place.

This second embodiment of the invention has the same advantage as the first embodiment in that it is readily detachable from the mounting means 20 or from other suitable mounting means.

In the drawings and specification, there have been set forth preferred embodiments of the invention, and although specific terms are employed, they are used in a generic and descriptive sense only and not for purposes of limitation.

That which is claimed is:

1. An ornamental fixture for suspendingly supporting potted plants or the like alongside a vertical surface such as the vertical surface of a supporting wall, fence or the like, and comprising:

an elongate skeletal bracket formed of rod-like material having a sinuous configuration including first and second end portions and a loop portion formed therein between said end portions, mounting means formed of rod-like material and adapted to be carried by said vertical surface and having a generally V-shaped configuration with the apex of the V forming a loop portion extending through said loop portion of the sinuous elongate skeletal bracket with the respective loop portions of said bracket and mounting means being at substantially right angles to each other and with the bights of the loops in detachable interengagement for mounting the bracket alongside the vertical surface, said mounting means also having a pair of wall engaging feet remote from said loop portion of the mounting means and adapted to engage the opposite vertical surface of the wall, fence or the like from the vertical surface alongside of which the bracket is supported, said elongate skeletal bracket including abutting means carried by said first end portion and being positioned below the point of detachable engagement of said loop portion of said bracket with said mounting means and extending laterally on remote opposite sides of the point of detachable engagement of said bracket to said mounting means for abuttingly engaging said vertical surface and stabilizing and positioning said bracket to extend in an outwardly projecting manner from said vertical surface, and said bracket including hook means carried by said second end portion and being positioned beneath and outwardly of and remote from said point of engagement of the bracket with the mounting means for suspendingly receiving thereon a potted plant or the like so that the potted plant will be suspendingly supported alongside the vertical surface.

* * * * *